US008952862B2

(12) United States Patent
Jacob et al.

(10) Patent No.: US 8,952,862 B2
(45) Date of Patent: Feb. 10, 2015

(54) DEVICE FOR COUPLING AND FASTENING A RADIATING ELEMENT OF AN ANTENNA AND METHOD OF ASSEMBLING AN ANTENNA

(75) Inventors: Gérard Jacob, Lannion (FR); Olivier Portier, Pleumeur Bodou (FR)

(73) Assignee: Alcatel Lucent, Boulogne-Billancourt (FR)

( * ) Notice: Subject to any disclaimer, the term of this patent is extended or adjusted under 35 U.S.C. 154(b) by 926 days.

(21) Appl. No.: 13/130,991

(22) PCT Filed: Nov. 24, 2009

(86) PCT No.: PCT/FR2009/052275

§ 371 (c)(1),
(2), (4) Date: Sep. 12, 2011

(87) PCT Pub. No.: WO2010/061122

PCT Pub. Date: Jun. 3, 2010

(65) Prior Publication Data

US 2012/0038540 A1 Feb. 16, 2012

(30) Foreign Application Priority Data

Nov. 25, 2008 (FR) ..... 08 57985

(51) Int. Cl.
*H01Q 1/22* (2006.01)

(52) U.S. Cl.
USPC ..... 343/878; 343/752

(58) Field of Classification Search
USPC ..... 343/878, 752, 834, 843, 867
See application file for complete search history.

(56) References Cited

U.S. PATENT DOCUMENTS

| | | | |
|---|---|---|---|
| 6,034,649 | A | 3/2000 | Wilson et al. |
| 6,069,590 | A | 5/2000 | Thompson, Jr. et al. |
| 2004/0183734 | A1 | 9/2004 | Noro |

(Continued)

FOREIGN PATENT DOCUMENTS

| | | | |
|---|---|---|---|
| CN | 1526952 | A | 9/2004 |
| CN | 2658957 | Y | 11/2004 |
| CN | 2891097 | Y | 4/2007 |

(Continued)

OTHER PUBLICATIONS

International Search Report for PCT/FR2009/052275 dated Feb. 4, 2010.

English Bibiliography for Japanese Patent Publication No. JP60124113A, published Jul. 3, 1985, printed from Thomson Innovation on Sep. 24, 2014, 4 pp.

English Bibiliography for Japanese Patent Publication No. JP6106511A, published Mar. 28, 1986, printed from Thomson Innovation on Sep. 24, 2014, 3 pp.

(Continued)

*Primary Examiner* — Karl D Frech
(74) *Attorney, Agent, or Firm* — Fay Sharpe LLP

(57) ABSTRACT

The panel type antenna includes a flat conductive mount including at least one orifice, at least one radiating element including a base mounted beneath a dipole and a device for coupling and fixing the radiating element to the support. The device for coupling and fixing the radiating element, comprising a base mounted beneath a dipole, on the support with a dielectric part including a base with a dimension greater than the orifice in the support, at least one rod joined with the base and extending in a direction perpendicular to the plane of the base through the orifice of the support adapted for the insertion of the rod, at least one protuberance built into the end of the rod able to cooperate with the radiating element to hold it in place. The device includes a dielectric layer between the radiating element and the conductive mount to avoid direct contact.

20 Claims, 4 Drawing Sheets

(56) References Cited

U.S. PATENT DOCUMENTS

Figure 1:
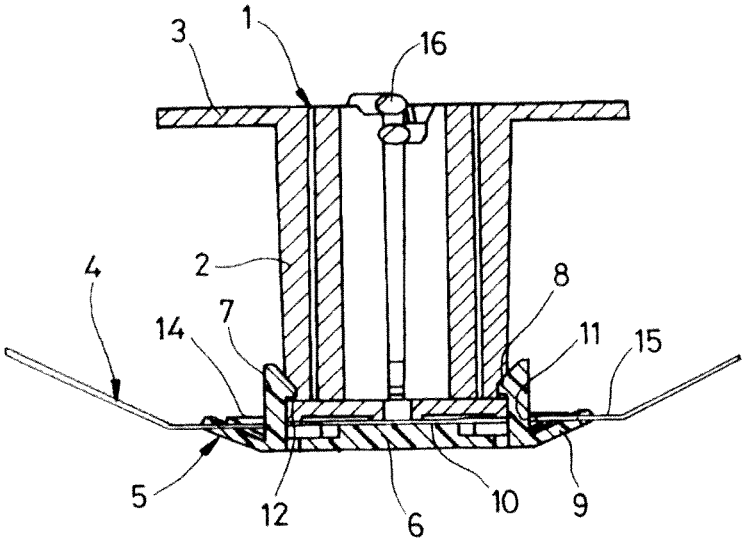

| | | | |
|---|---|---|---|
| 2004/0201537 | A1 | 10/2004 | Stolle et al. |
| 2008/0096442 | A1 | 4/2008 | Fukaya et al. |

FOREIGN PATENT DOCUMENTS

| | | | |
|---|---|---|---|
| CN | 10109318 | A | 12/2007 |
| DE | 10 2004 045107 | A1 | 3/2006 |
| JP | 60-124113 | A | 7/1985 |
| JP | 61-60511 | A | 3/1986 |
| WO | WO 99/43033 | A1 | 8/1999 |

OTHER PUBLICATIONS

English Bibiliography for Chinese Patent Publication No. CN2658957Y, published Nov. 24, 2004, printed from Thomson Innovation on Sep. 24, 2014, 4 pp.

English Bibiliography for Chinese Patent Publication No. CN1526952A, published Sep. 8, 2004, printed from Thomson Innovation on Sep. 24, 2014, 3 pp.

English Bibiliography for Chinese Patent Publication No. CN2891097Y, published Apr. 18, 2007, printed from Thomson Innovation on Sep. 24, 2014, 3 pp.

English Bibiliography for Chinese Patent Publication No. CN101093918A, published Dec. 26, 2007, printed from Thomson Innovation on Sep. 24, 2014, 3 pp.

DEVICE FOR COUPLING AND FASTENING A RADIATING ELEMENT OF AN ANTENNA AND METHOD OF ASSEMBLING AN ANTENNA

The present invention pertains to the field of telecommunications antennas transmitting radio waves in the field of hyperfrequencies by means of radiating elements. The present invention more particularly pertains to a device making it possible to quickly, reliably, and inexpensively couple and fasten a radiating element onto a flat metallic mount during the assembly of an antenna.

Furthermore, it extends to an antenna comprising such a device and to the method for assembling such an antenna.

The construction of an antenna comprises the steps of mechanically fastening its components onto one another. Today, most antenna manufacturers use a mechanical assembly comprising a chassis constituting a central mechanical axis onto which all the other components are fastened, such as radiating elements, power dividers, phase-shifters, reflective walls, parasitic elements, etc. Once all of the elements have been assembled around the chassis, the assembly is surrounded by a radome.

In order to withstand the mechanical force due to the weight of the components and to the environment, this chassis is manufactured from a metallic material of sufficient hardness and thickness. This initial restriction limits the later mechanical choices. It requires that the compromises in design, particularly between the electrical and mechanical factors and the manufacturing costs, be mainly guided by the mechanical requirements in view of ensuring performance stability. For example, an antenna about 2 m long working within a frequency band of around 2 GHz comprises an aluminum chassis between 1.5 mm and 2.5 mm thick. However, if only the depth related to the skin effect were to be taken into account in the frequency domain, the required thickness would only be less than 0.1 mm. The presence of metallic connections and their positioning between the components makes it necessary to choose mechanical solutions such as screwing or welding. These joining techniques entail additional costs, in particular due to the time required to perform the operation and by the need for advanced quality control of the resulting connection, and they make disassembly perilous or even impossible. In other words, due to the inevitable degradation of the electrical contacts, the antenna might be faced with intermodulation product (IMP) problems that result in a distortion of the signals traveling through the antenna, such as a loss of performance if these degradations occur in places where electromagnetic fields are intense.

Panel antennas comprise an array of radiating elements, which may be dipoles, fastened onto a metallic chassis which is a flat reflector. The problem is therefore finding a device that would make it possible to position and fasten these dipoles onto the chassis quickly, reliably, reversibly, and inexpensively, in order to obtain a link that is mechanically and electrically effective and free of intermodulation products.

The sought-after solution must particularly take into account the following requirements simultaneously:

- avoiding screwing and/or welding to mechanically assemble the dipoles and the reflector;
- creating capacitive electrical connections, i.e. with no direct metal-metal contact.

The document U.S. Pat. No. 6,933,906 describes an antenna comprising a dipole linked capacitively in a contact-free manner to a reflector by means of a coupling and fastening structure that is not electrically conductive, disposed between the foot of the radiating element and the reflector.

The coupling and fastening structure is a plug made of dielectric material. The base of the dipole is inserted and held into the plug equipped with reliefs, which is then anchored through rotation into an orifice with matching shape and dimension built into the reflector. In order to pull the plug in place, additional fastening means are provided such as screws inserted into a hole in the plug made of plastic and into a hole in the reflector, taking care not to establish an electrical connection with the dipole.

However, this coupling and fastening structure exhibits the drawback of still requiring the use of screw-based fastening means to ensure the reliability of the fastening, particularly to prevent the rotation of the plug and its disengagement from the orifice. Furthermore, such an assembly is harmful from the standpoint of the coupling surface. The substantial surface area occupied by the orifice built into the reflector, whose surface area is equal to or greater than that of the plug, reduces the coupling surface between the reflector and dipole accordingly.

It is a purpose of the present invention to eliminate the drawbacks of the prior art, and in particular to disclose a device for coupling and fastening a radiating element of an antenna onto a flat metallic mount such that the coupling surface area is maximized.

It is also a purpose of the present invention to disclose a device for coupling and fastening a radiating element onto a flat metallic mount which does not require screwing or welding.

It is also a purpose of the present invention to disclose an antenna comprising radiating elements fastened onto a flat metallic mount, the mount's thickness being less than in the prior art without compromising the mechanical strength of the antenna.

It is also a purpose of the present invention to disclose a method for coupling and fastening a radiating element onto a flat metallic mount that is faster than, yet also as reliable as, the methods of the prior art.

The object of the present invention is a device for coupling and fastening a radiating antenna element, comprising a foot mounted beneath a dipole, onto a flat conductive mount equipped with an orifice. The device comprises a dielectric part comprising:

- a base whose dimension is greater than the dimension of the orifice built into the mount,
- at least one rod joined with the base, extending into a direction perpendicular to the base's plane,
- at least one protuberance arranged at the end of the rod capable of cooperating with the radiating element to retain it.

The device also comprises a dielectric layer placed between the radiating element and the conductive mount to avoid any direct contact.

The presence of a dielectric layer between the radiating element and the mount makes it possible to guarantee the electrical insulation, and thereby to create capacitive coupling between the radiating element and the reflector. The dielectric part, as it no longer needs to provide this function, may thereby be optimized with respect to the ease with which the radiating element may be fastened.

According to one preferred embodiment, the base of the dielectric part comprises at its periphery bent petals adapted to enable spring-style contact with the mount. The peripheral edge of the base is slitted so as to form petals which are bent slightly in order to extend out from the base. When the dielectric part is installed, the petals first are abutting the mount, providing a spring effect that contributes to keeping the radiating element in the desired position.

According to one embodiment, the base of the dielectric part comprises at least one orifice for inserting an electrical power supply of the radiating element. This enables the insertion of power means beneath the mount in order to keep clear the surface of the mount supporting the radiating elements and forming a reflector. In this case, the mount further comprises offices for inserting power means.

In a first variant, the dielectric part comprises at least one rod capable of cooperating with the exterior of the radiating element's foot. The rod extends perpendicular to the base of the dielectric part and traverses the mount through an orifice of appropriate size. The rod is placed along the exterior of the food so as to enable the protuberance borne by its and to anchor itself into a notch built for that purpose on the outer surface of the foot in order to retain the radiating element.

In a second variant, the dielectric part comprises at least one rod capable of being inserted into a hollow tube disposed within the foot of the radiating element. The rod extends perpendicular to the base of the dielectric part and traverses the mount through an orifice of appropriate size. The rod is inserted into one of the hollow tubes built into the foot of the radiating element so as to enable the protuberance borne by its end to anchor itself into a notch built for that purpose on the inner surface of the tube in ID order to retain the radiating element.

In another embodiment, the protuberance at the end of the rod has a hook shape. This shape enables it to better cooperate with a notch that may have the shape of a relief or a housing shaped to be suitable for the shape of the hook.

One advantage of the invention is providing an exact positioning of the radiating element compared to the reflector by prohibiting its rotation and guaranteeing its fastening by exercising an axial retention force onto the element.

A further object of the invention is a panel antenna comprising

- at least one radiating element comprising a foot mounted beneath a dipole,
- a device for coupling and fastening a radiating element as previously described,
- a flat conductive mount comprising at least one orifice suitable for inserting the rod of the dielectric part.

One advantage of the inventive antenna is that it may be assembled quickly with great reliability while requiring fewer human and equipment means.

Preferentially, the antenna further comprises a stiffener disposed between the longitudinal ends of the mount.

A further purpose of the invention is a method for assembling an antenna by means of a device for coupling and fastening a radiating element as previously described, comprising the following steps:

- the rod of the dielectric part is inserted into the orifice of the mount so as to bring the base of the dielectric part in contact with the rear surface of the mount,
- the foot of the radiating element is axially pushed into the dielectric part on the front face side of the mount, so that the protuberance borne by the end of the rod cooperates with at least one notch of the foot in order to retain the radiating element.

Figure 2:
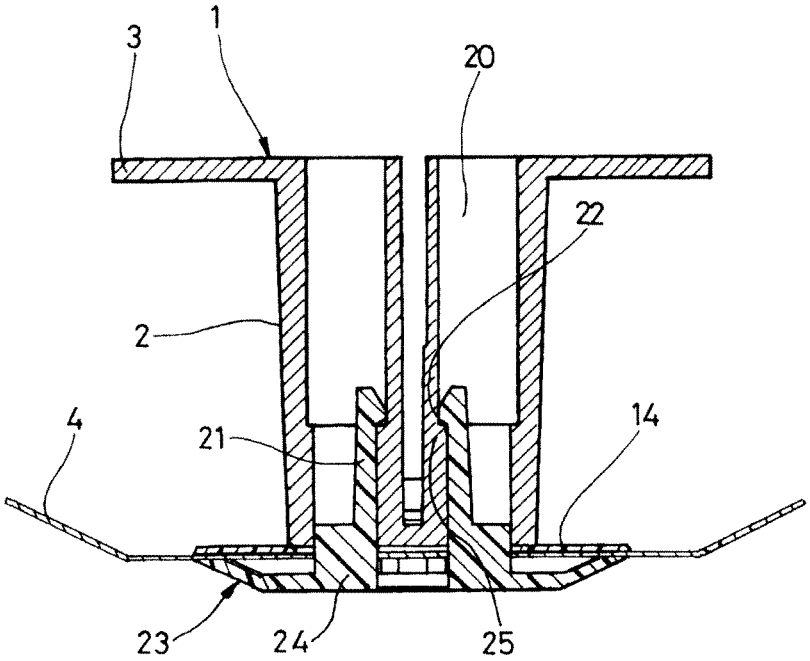
Figure 3:
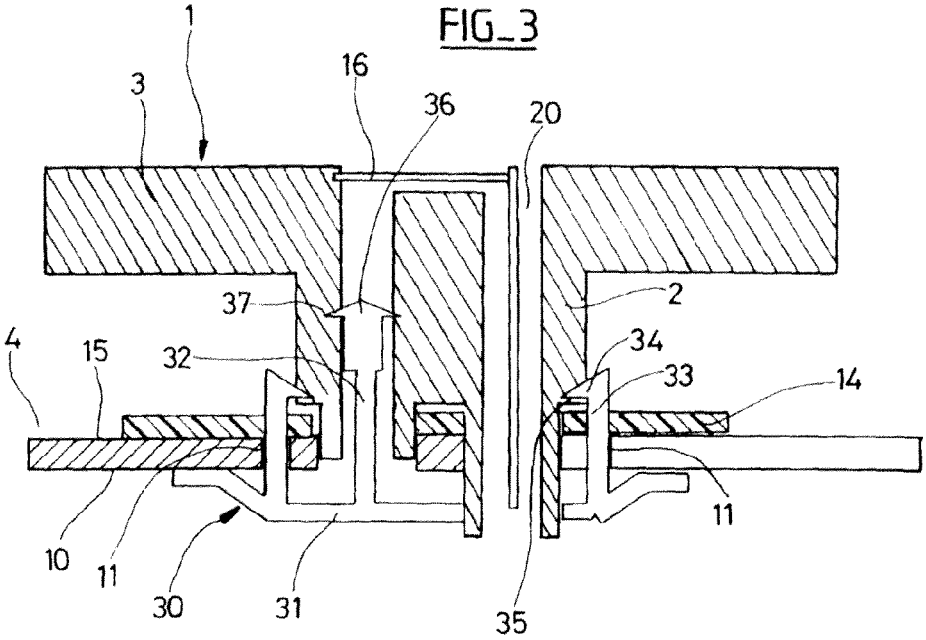
Figure 4:
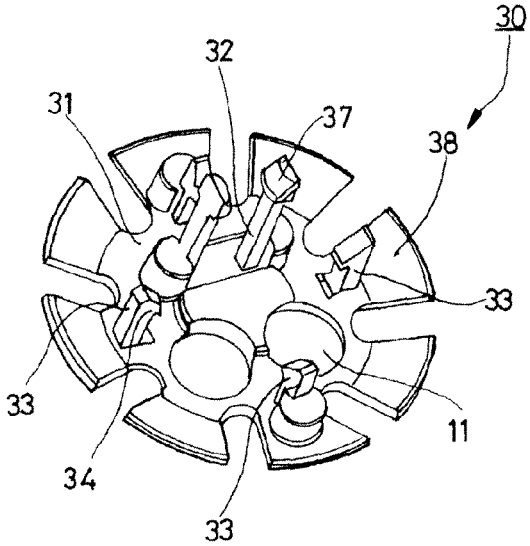
Figure 5:
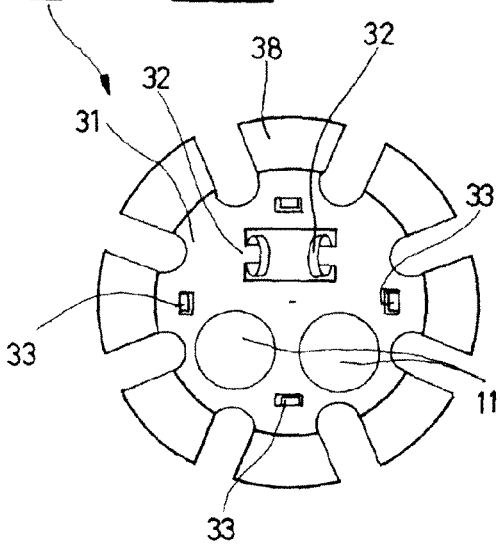
Figure 6:
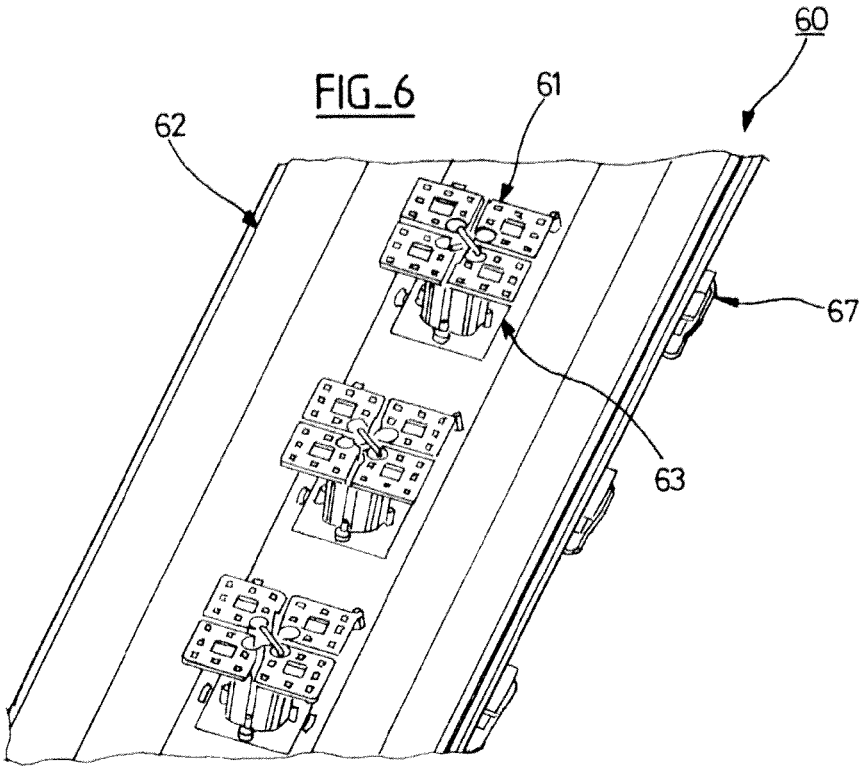
Figure 7:
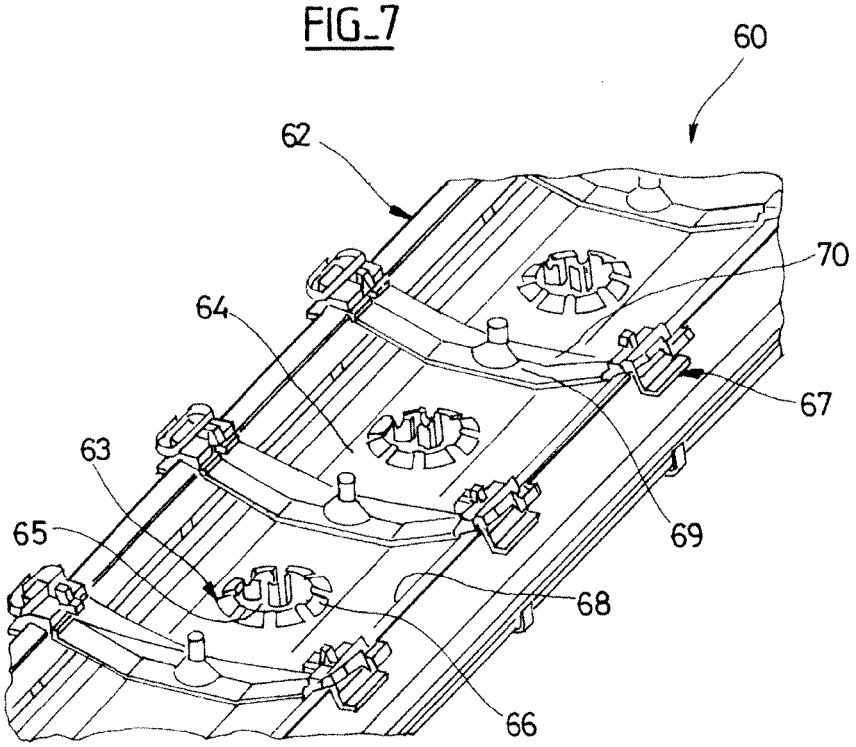
Figure 8:
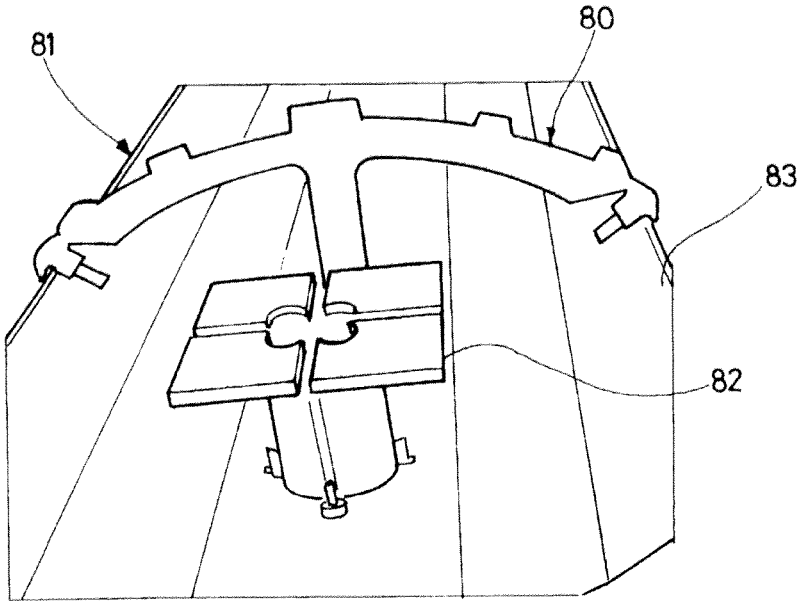

Other characteristics and advantages of the invention will become apparent while reading the following description of embodiments, which are non-limiting and given for purely illustrative purposes, and in the attached drawing, in which:

FIG. 1 is a schematic cross-section view of a first embodiment of the assembling of a radiating element of an antenna by the inventive method and by means of the inventive device, FIG. 2 is a schematic cross-section view of a second embodiment of the assembling of a radiating element of an antenna by the inventive method and by means of the inventive device, FIG. 3 is a schematic cross-section view of a third embodiment of the assembling of a radiating element of an antenna by the inventive method and by means of the inventive device, FIG. 4 is a schematic top view in perspective of a dielectric part of the device according to the third embodiment of the invention, FIG. 5 is a schematic bottom view of a dielectric part of the device according to the third embodiment of the invention, FIG. 6 is a schematic top view in perspective of an antenna portion according to one embodiment of the invention, FIG. 7 is a schematic bottom view in perspective of the antenna of FIG. 6, FIG. 8 is a schematic top view in perspective of an antenna portion showing another embodiment of a stiffener.

In the embodiment of the invention depicted in FIG. 1, a radiating element 1 is shown, comprising a foot 2 supporting at least one dipole 3, and a reflector 4 onto which the radiating element 1 is fastened by means of a dielectric part 5. The dielectric part 5 comprises a base 6 mounted beneath rods 7 bearing reliefs 8 forming hooks, the periphery of the base 6 being slit in order to form slightly bent petals 9. The base 6 of the dielectric part 5 is applied to the rear surface 10 of the reflector 4. The reflector 4 comprises orifices 11 through which the rods 7 are inserted. These orifices 11 have just the right size needed to insert rods 7 mounted beneath their reliefs 8. In the present situation, the lower part of the foot 2 of the radiating element 1 comprises a recess 12 constituting a notch onto which the relief 8 hooks in order to retain the radiating element 1.

The part 5 is made up of a dielectric material that affords it a certain flexibility, preferentially a polymer like a polyoxymethylene (POM), a fiberglass-reinforced polyoxymethylene (POM) a polyethylene (PE), a polystyrene (PS), a acrylonitrile/butadiene/styrene (ABS), a acrylonitrile/styrene/acrylate polymer (ASA), etc. The periphery of the base 6 is slit so as to form slightly bent petals 9 which are relatively more flexible than the central part 13 of the base 6. The base 6 thereby elastically supports the rear surface 10 of the reflector 4 through the intermediary of its petals 9. This elastic support exerts a force onto the hook 8 that ensures that the radiating element 1 is held in place by the spring effect. Once in place, the radiating element 1 is firmly maintained, and the assembly does not require any additional fastening means. An insulating layer 14 is interspersed between the lower part of the foot 2 of the radiating element 1 and the front face 15 of the reflector 4 in order to avoid any direct contact and thereby create capacitive coupling between the radiating element 1 and the reflector 4. The dielectric layer 14 is for example a thin isolating polyethylene (PE) film having a thickness on the order of 0.1 mm. Preferentially, a colored film will be used to facilitate controls.

The foot 2 of the radiating element 1 most commonly comprises four juxtaposed hollow tubes 20 intended for the insertion of the power-supplying conductive wires 16 of the dipoles 3. In the embodiment depicted in FIG. 2, two tubes 20 not used for powering the dipole 3 are available to accommodate the rods 21 bearing a protuberance 22 belonging to a dielectric part 23. The dielectric part 23 comprises a base 24 mounted beneath rods 21 bearing protuberances 22 forming hooks. The rods 21 are disposed more centrally on the base 24 than in the previous cases so as to correspond to the location of the tubes 20 into which they are inserted. A recess 25 was built into the internal surface of the tubes 20 so as to form a notch into which the protuberance 22 may hook.

We shall now consider FIG. 3 which depicts one advantageous embodiment of the inventive fastening device. In this embodiment, a radiating element 1, comprising a foot 2 and at least one dipole 3, is fastened onto a flat reflector 4 by means of a dielectric part 30.

The dielectric part 30 is depicted in perspective view in FIG. 4 and top view in FIG. 5. The dielectric part 30 comprises a base 31 from which extends at least one central rod 32, two in the present case, and at least one peripheral rod 33, four in the present situation. The peripheral rod 33 is equipped with an end forming a hook 34 which cooperates with a relief 35 built into the foot 2 of the radiating element. The rods 33 traverses the flat reflector through the orifices 11 sized to be just large enough to allow them through. The central rod 32 bears a double hook 36 at its end. The central rod 32 is inserted in one of the hollow tubes 20 of the radiating element 1, which is not occupied by a power supply conductor 16. The hook 36 cooperates with housings 37 built into the inner surface of the tube 20.

The assembling is carried out beginning with the installation of the dielectric part 30 through the rear face 10 of the reflector 4. The rods 32, 33 are inserted into orifices 11 of the reflector 4. The base 31 is pressed against the rear face 10 of the reflector 4, the periphery of the base 31 being slit so as to form petals 38 elastically supporting the face 10. An insulating film 14 is deposed on the front face 15 of the reflector 4. The foot 2 of the radiating element 1 is then axially pressed into the dielectric part 30 so that the rods 32 are inserted into the tubes 20 of the foot 2 of the radiating element, and the rods 33 move into place around the foot 2. A final application of pressure causes the hooks 34, 36 to click into the inner or outer notches 35, 37 of the foot 2 in order to retain the radiating element 1. The radiating element 1 thereby comes to support the front face 15 of the reflector 4 through the intermediary of the insulating film 14 that prohibits any direct contact between the radiating element 1 and the reflector 4.

An antenna 60 assembled according to the method that was just described is depicted in perspective view in FIG. 6. The antenna 60 comprises radiating elements 61 aligned and fastened onto a reflector 62 by means of a dielectric part 63 similar to the one previously described.

The lower surface 64 of the reflector 62 of the antenna 60 is depicted in FIG. 7. It shows the base 65 of the dielectric part 63 elastically resting against the lower surface 64 of the reflector 62 through the intermediary of the petals 66 cut into its periphery and slightly bent. These petals 66 serve as a spring for exerting a traction force onto the protuberances borne by the end of the rods hooked into the notches of the foot of the radiating element 61. An appropriate force is exerted onto the radiating elements 61 which are thereby reliably and effectively retained and they are protected from motion due to shocks or vibrations.

On the lower surface 64, stiffeners 67 were installed. The stiffeners 67 are fastened onto the folded longitudinal edges 68 opposite the lower surface 64 of the reflector 62 onto which they exert moderate pressure so as to prevent the edges 68 from coming together. The stiffener 67 comprises a base 69 whose shape combines that of the reflector 62 and a peak 70 found on the base 69 and contributes to the rigidity of the stiffener 67. These stiffeners 67 are made of a rigid material, preferentially dielectric, e.g. a polymer such as a polyoxymethylene (POM), a fiberglass-reinforced polyoxymethylene (POM) a polyethylene (PE), a polystyrene (PS), an acrylonitrile/butadiene/styrene (ABS), an acrylonitrile/styrene/acrylate copolymer (ASA), etc.

FIG. 8 shows another embodiment of a stiffener 80 placed on the upper surface of a reflector 81 supporting radiating elements 82. The stiffeners 80 are disposed between the radiating elements 82. These stiffeners 80 have the shape of circle arcs and rest on the longitudinal edges 83 of the reflector 81.

The invention claimed is:

1. A panel antenna, comprising:

at least one radiating element comprising a foot mounted beneath a dipole, a flat conductive mount comprising at least one orifice, and a device coupling and fastening the at least one radiating element to the flat conductive mount, the device comprising a dielectric part, comprising:

a base including at least one rod extending in a direction perpendicular to a plane for the base, and a dielectric layer placed between the at least one radiating element and the flat conductive mount to avoid contact between the at least one radiating element and the flat conductive mount, wherein the at least one rod of the base in the dielectric part is inserted in the at least one orifice of the flat conductive mount, wherein a dimension of the base is greater than a corresponding dimension of the at least one orifice of the flat conductive mount and the base is applied to a rear face of the flat conductive mount.

2. The panel antenna according to claim 1, wherein the base of the dielectric part comprises, at its periphery, bent petals adapted to enable spring-style contact with the flat conductive mount.

3. The panel antenna according to claim 1, wherein the base of the dielectric part comprises at least one orifice for inserting an electrical power supply of the at least one radiating element.

4. The panel antenna according to claim 1, the dielectric part further comprising:

at least one rod cooperating with an exterior of the foot of the at least one radiating element.

5. The panel antenna according to claim 1, the dielectric part further comprising:

at least one rod inserted in a hollow tube disposed within the foot of the at least one radiating element.

6. The panel antenna according to claim 1, further comprising a stiffener disposed between longitudinal edges of the flat conductive mount.

7. The panel antenna according to claim 1, wherein the at least one rod of the base in the dielectric part comprises at least one protuberance arranged at an end of the at least one rod, the at least one protuberance cooperating with and retaining the at least one radiating element.

8. The panel antenna according to claim 7, wherein the at least one protuberance at the end of the at least one rod has a hook shape.

9. A method for assembling a panel antenna, comprising:

obtaining at least one radiating element including a foot mounted beneath a dipole, obtaining a flat conductive mount including at least one orifice, obtaining a device for coupling and fastening the radiating element to the mount, the device including a dielectric part that includes a base with at least one rod extending in a direction perpendicular to a plane for the base and a dielectric layer for placement between the at least one radiating element and the flat conductive mount to avoid contact between the at least one radiating element and the flat conductive mount, wherein a dimension of the base is greater than a corresponding dimension of the at least one orifice of the flat conductive mount, and inserting the at least one rod of the dielectric part in the at least one orifice of the flat conductive mount so as to bring the base of the dielectric part in contact with a rear surface of the mount, wherein the foot of the at least one radiating element is axially pushed into the dielectric part on a front face side of the flat conductive mount such that a protuberance borne by an end of the at least one rod cooperates with at least one notch of the foot in order to retain the at least one radiating element.

10. The method according to claim 9, wherein the base of the dielectric part comprises, at its periphery, bent petals adapted to enable spring-style contact with the flat conductive mount.

11. The method according to claim 9, wherein the base of the dielectric part includes at least one orifice and the at least one radiating element includes an electrical power supply, the method further comprising:

inserting the electrical power supply of the at least one radiating element in the at least one orifice of the base.

12. The method according to claim 9, wherein the dielectric part includes at least one rod cooperating with an exterior of the foot of the at least one radiating element.

13. The method according to claim 9, wherein the dielectric part includes at least one rod and the foot of the at least one radiating element includes a hollow tube, the method further comprising:

Inserting the at least one rod of the dielectric part in the hollow tube of the foot of the at least one radiating element.

14. The method according to claim 9, further comprising positioning a stiffener between longitudinal edges of the flat conductive mount.

15. The method according to claim 9, wherein the at least one rod of the base in the dielectric part includes at least one protuberance arranged at an end of the at least one rod, the method further comprising:

positioning the base of the dielectric part such that the at least one protuberance of the at least one rod cooperates with and retains the at least one radiating element.

16. The method according to claim 15, wherein the at least one protuberance at the end of the at least one rod has a hook shape.

17. A panel antenna, comprising:

at least one radiating element with a foot mounted beneath a dipole, a flat conductive mount with at least one orifice, and a device coupling and fastening the at least one radiating element to the flat conductive mount, the device comprising a dielectric part, comprising:

a base, at least one rod joined with the base and extending in a direction perpendicular to a plane for the base, and a dielectric layer placed between the at least one radiating element and the flat conductive mount to avoid contact between the at least one radiating element and the flat conductive mount, wherein the at least one rod of the base in the dielectric part is inserted in the at least one orifice of the flat conductive mount, wherein a dimension of the base is greater than a corresponding dimension of the at least one orifice of the flat conductive mount and the base is applied to a rear face of the flat conductive mount, wherein the at least one rod of the base in the dielectric part includes at least one protuberance arranged at an end of the at least one rod, the at least one protuberance cooperating with and retaining the at least one radiating element.

18. The panel antenna according to claim 17, the dielectric part further comprising:

at least one rod inserted in a hollow tube disposed within the foot of the at least one radiating element.

19. The panel antenna according to claim 17, wherein the at least one protuberance at the end of the at least one rod has a hook shape.

20. The panel antenna according to claim 17, further comprising:

a stiffener disposed between longitudinal edges of the flat conductive mount.

* * * * *